United States Patent [19]

McAllister

[11] 4,019,303

[45] Apr. 26, 1977

[54] ADJUSTABLE SPLIT DOOR JAMB

[75] Inventor: Owen Earl McAllister, Oshkosh, Wis.

[73] Assignee: Combustion Engineering, Inc., Windsor, Conn.

[22] Filed: Nov. 19, 1975

[21] Appl. No.: 633,194

Related U.S. Application Data

[62] Division of Ser. No. 462,475, April 19, 1974, Pat. No. 3,981,103.

[52] U.S. Cl. ..... 52/745; 49/505; 52/631

[51] Int. Cl.[2] ..... E04C 2/00; E06B 1/04

[58] Field of Search ..... 52/631, 745, 211; 49/505; 29/155, 527.2

[56] References Cited

UNITED STATES PATENTS

| | | | |
|---|---|---|---|
| 1,440,615 | 1/1923 | Meyercord | 52/631 X |
| 2,149,882 | 3/1939 | Clements | 52/631 X |
| 3,654,053 | 4/1972 | Toedter | 52/631 |
| 3,757,473 | 9/1973 | Mundy | 49/505 X |

*Primary Examiner*—J. Karl Bell

*Attorney, Agent, or Firm*—Stephen L. Borst; Eldon H. Luther

[57] ABSTRACT

A process for making an adjustable split door frame is disclosed, the process comprising the steps of cladding the front surface of the board with vinyl, grooving a plurality of parallel grooves of various shapes in the back surface of the board down to but not through the vinyl, folding and gluing the board along the grooves, inserting a support member and attaching a hard board to the back surface of the resulting door frame. In addition, a second board is clad, grooved and folded in a similar manner to provide the other half of the split adjustable door frame.

3 Claims, 10 Drawing Figures

12
11
10
9
8
7
6
5
20
28
28'
39
38
40
30
3
4
2
1
44
46
50
42
48

ADJUSTABLE SPLIT DOOR JAMB

This is a division of application Ser. No. 462,475 filed Apr. 19, 1974 now U.S. Pat. No. 3,981,103.

BACKGROUND OF THE INVENTION

This invention relates to a process or method of manufacturing an adjustable door frame which is adjustable over a wide range of thicknesses to accommodate variations in wall thicknesses. More specifically, this invention relates to a process or method of manufacturing a pre-assembled adjustable split door frame from a vinyl covered board by a minimum of time consuming and costly steps.

Prior art technology may be found in the preassembled adjustable door jamb art which discloses cladding a plurality of board members with vinyl, grooving the back surfaces of the boards, folding and gluing the boards along the grooves and assembling the various pieces into a preassembled door frame. However, these prior art methods have the drawback that they require a superfluity of separate assembly steps, each unnecessary step requiring the expenditure of unnecessary time and money. The present invention advances the prior art technology by reducing the total number of steps required to manufacture a pre-assembled vinyl clad door frame and in so doing allows the production of a less expensive, more aesthetically appealing final product.

SUMMARY OF THE INVENTION

This invention discloses a process of manufacturing a pre-assembled adjustable split door frame. The process comprises the steps of cladding the front surface of a base board with vinyl and grooving the back surface of the board down to a depth of the thickness of the board, thereby obtaining a monolithic base board. In total, four parallel V-shaped grooves are made with two parallel plowed grooves machined between the middle most two V-shaped grooves. By so grooving the board, the board material is removed leaving the vinyl, which then allows the board to be folded along the V-shaped grooves using the vinyl as a hinge. The adjacent surfaces are then secured to one another. In addition, one of the plowed grooves is folded by rotating the two adjacent surfaces away from one another and a support member is attached between the two adjacent surfaces to secure in perpendicular relationship. The surfaces of a second plowed groove are secured in partial abutting relationship after they have been moved toward each other and offset by an amount equal to the width of the plowed groove. A piece of hard board is attached to the back portion of the completed folded member thereby forming a slot between the hard board and a portion of the folded member. A second piece of folded vinyl clad board is also manufactured in a similar manner by grooving the back surfaces of the board and folding and gluing. This second member forms the second half of the split adjustable door frame and slides into the slot formed by the first half of the split adjustable door frame.

DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE PREFERRED EMBODIMENT

Figures 1A, 1B, 1C:
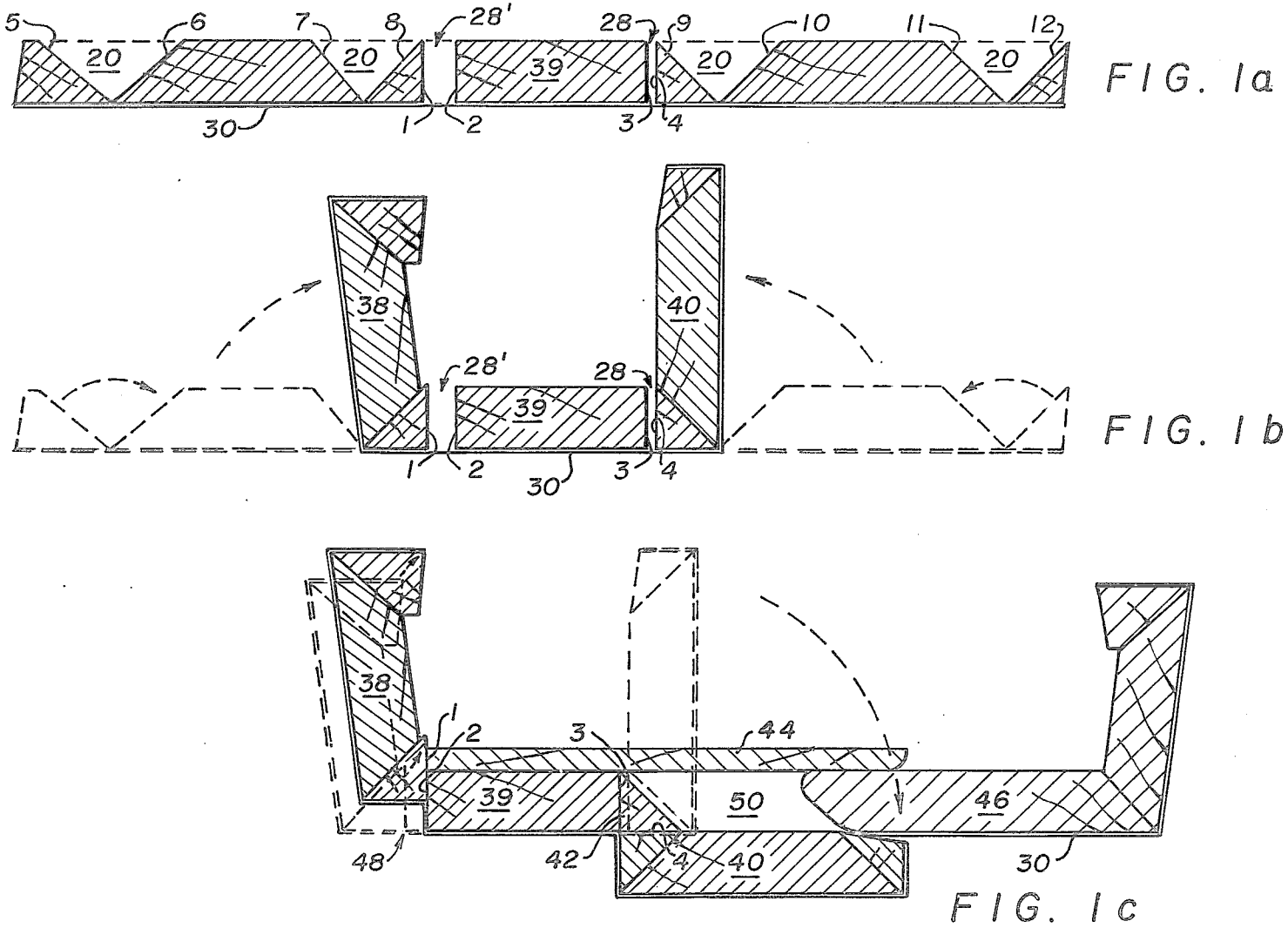
FIG. 1*a* depicts a monolithic particle board in cross section, one surface of which has been clad with vinyl and the back surface of which has been grooved down to the vinyl.
FIG. 1*b* is an illustration of the particle board of FIG. 1*a* after it has been folded and glued along the V-shaped grooves.
FIG. 1*c* is an illustration of the particle board of FIG. 1*b* in its final configuration as part of the adjustable split door frame.
Figure 2A:
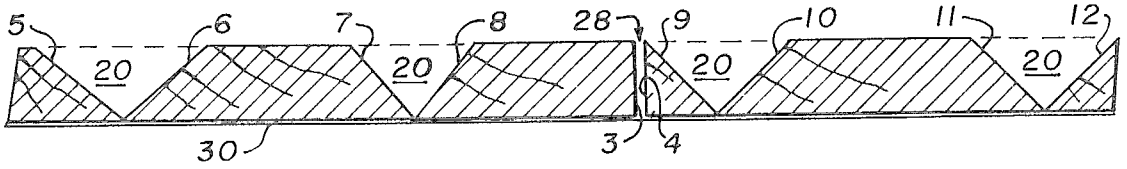
FIG. 2*a* depicts a second embodiment of the monolithic particle board of FIG. 1*a*.
Figure 4A:
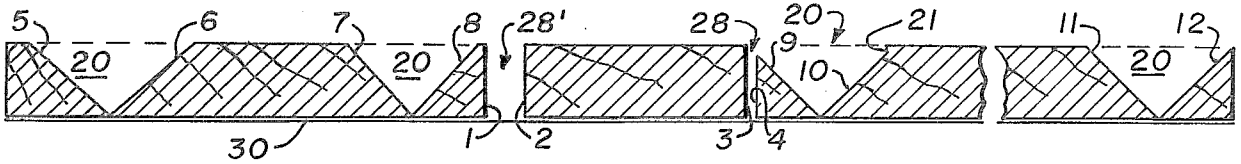
FIG. 4*a* and 4*b* illustrate monolithic base boards for the manufacture of the female member of a split door frame.
Figure 4B:
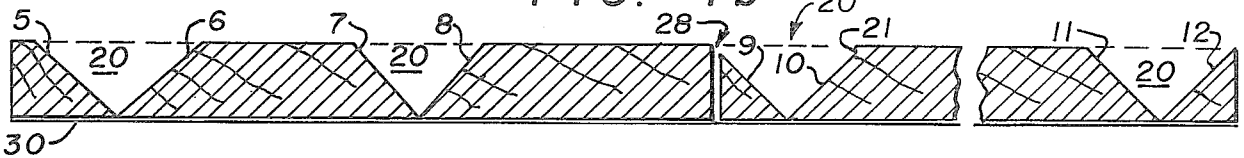
Figure 5:
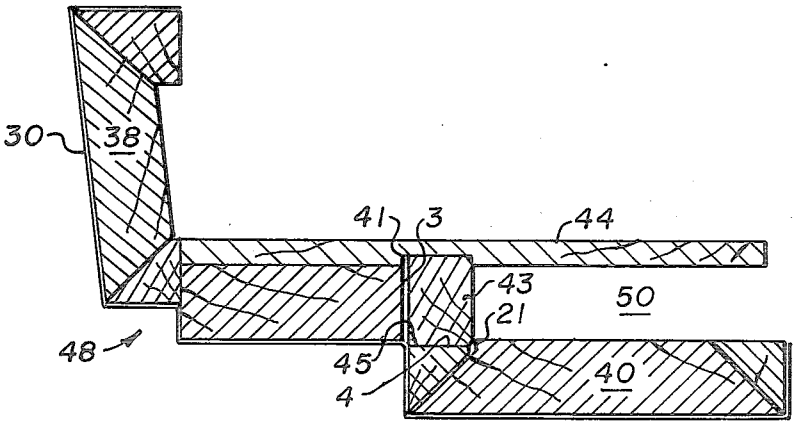
FIG. 5 illustrates a female member of a split door frame having a trapped supporting member.

FIGS. 1*a*, 1*b* and 1*c* illustrate the steps of the preferred embodiment of the invention. In order to manufacture a preassembled adjustable split door frame, a board consisting of any appropriate building material such as particle board, flake board, plywood or masonite, is clad with a vinyl cladding 30 or with some other appropriate flexible material. Then the board is fed through a grooving machine which machines a plurality of grooves 20, 28 and 28' into its back surface, thereby obtaining a monolithic board which is used as the base stock in the manufacturing process described below. These grooves are machined into the board to a depth of the thickness of the board thereby removing the board material down to the cladding material but leaving the cladding intact. In the preferred embodiment four V-shaped grooves 20 and two plowed grooves or square grooves 28 and 28' are machined into the board. The plowed grooves are machined into the board intermediate the middlemost two V-shaped grooves forming a middle portion 39 there between. In a second embodiment only one plowed groove is machined between the middlemost two V-shaped grooves as shown in FIG. 2*a*. In a further modification, see FIGS. 4 and 5, one of the plowed grooves 28 is caused to overlap one of the V-shaped grooves 20 so that the grooves are at least in part laterally coextensive. The opposite surface 10 of the same V-shaped groove 20 may also have a vertical wall portion 21. These modifications cause the formation of a recess 45 into which a rectangular support member 43 (see FIG. 5) fits thereby enabling the support member 43 to be trapped or interlocked with the door frame. Each of the V-shaped grooves 20 defines adjacent pairs of surfaces respectively. These pairs of adjacent surfaces are designated in FIG. 1*a* by the pairs of numbers 5,6; 7,8; 9,10; and 11,12. The plowed grooves respectively define first and second, third and fourth facing adjacent surfaces numbered 1, 2, 3, 4 respectively.

After the board has been machined to produce the grooves, the board is folded along the V-shaped grooves bringing the adjacent surfaces into abutting relationship. At the first end of the board, surfaces 5 and 6 are secured together by gluing or other acceptable method of attachment as are surfaces 7 and 8. This section of the board, after the first two grooves 20 have been folded and glued, defines a first folded end 38 as shown in FIG. 1*b*. Similarly, at the second end the remaining two V-shaped grooves are folded and glued defining a second folded end 40.

Figure 2B:
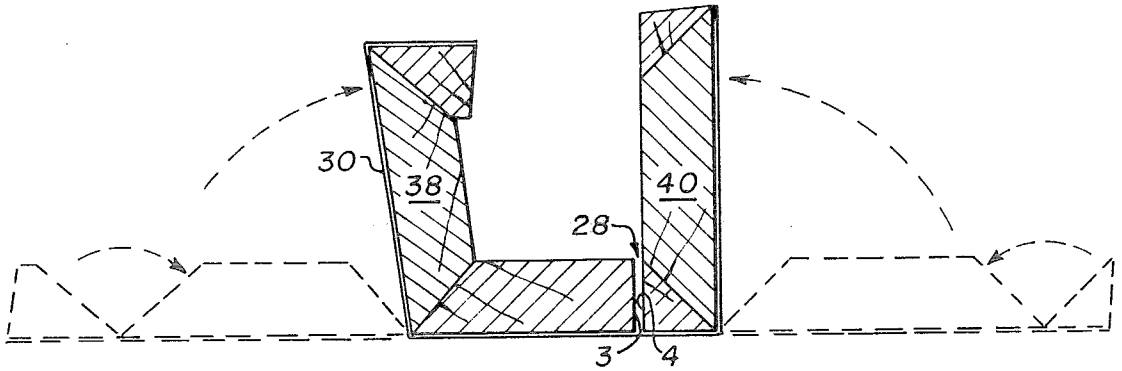
FIG. 2*b* and 2*c* illustrate the successive steps for the manufacture of the second embodiment and are similar to FIGS. 1*b* and 1*c* illustrate the successive steps for the manufacture of the second embodiment and are similar to FIGS. 1*b* and 1*c*.
Figure 2C:
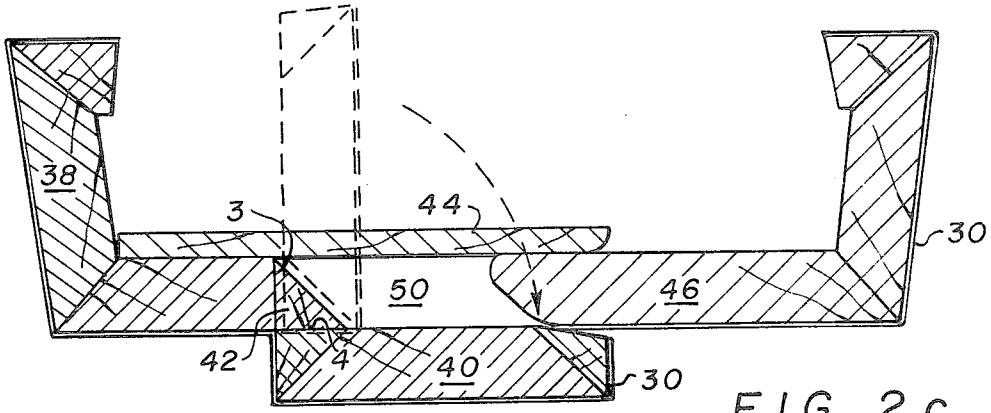

The next step of the process is to fold the board along plowed groove 28' so that adjacent surfaces 1 and 2 are moved toward each other while at the same time being displaced by a distance equivalent to the width of the groove. Accordingly, first folded end 38 moves upwardly relative to the middle portion of the board 39. The abutting portions of surfaces 1 and 2 are then similarly secured in this offset abutting relationship to define an attractive and appealing reveal 48 which is similar in appearance to the reveals which appear on conventional door frames constructed by carpenters out of individual pieces of wood. This reveal 48 and the steps for producing the reveal, are absent in the second embodiment illustrated in FIGS. 2*a*, 2*b* and 2*c*.

The next step in the process is to swing or rotate second folded end 40 downwardly so that surfaces 3 and 4 move away from one another to a position where surfaces 3 and 4 define an angle of substantially 90° between each other. A supporting member such as a piece of white pine 42 is then attached between surfaces 3 and 4 to hold surfaces 3 and 4 in their 90° relationship. In the preferred embodiment, the width of the original groove 28 which defines surfaces 3 and 4 is made as small as possible. In the art this narrow groove is called a Kerf. Finally, a piece of hard board 44 or some other such suitable material is fastened to the intermediate member 39 so that it projects outwardly parallel to the second folded end 40 and so that it defines a slot 50 between its projecting part 44 and the folded member 40. This completes the manufacture of one-half of the split adjustable door frame 52. A modification which may accompany the the modification previously described above which enables the supporting member 43 to be locked into the door frame is to provide board 44 with a recessed portion 41 corresponding to the support member 43 (See FIG. 5). This interlocking modification substantially increases the strength of the female member of the split door frame.

Figure 3:
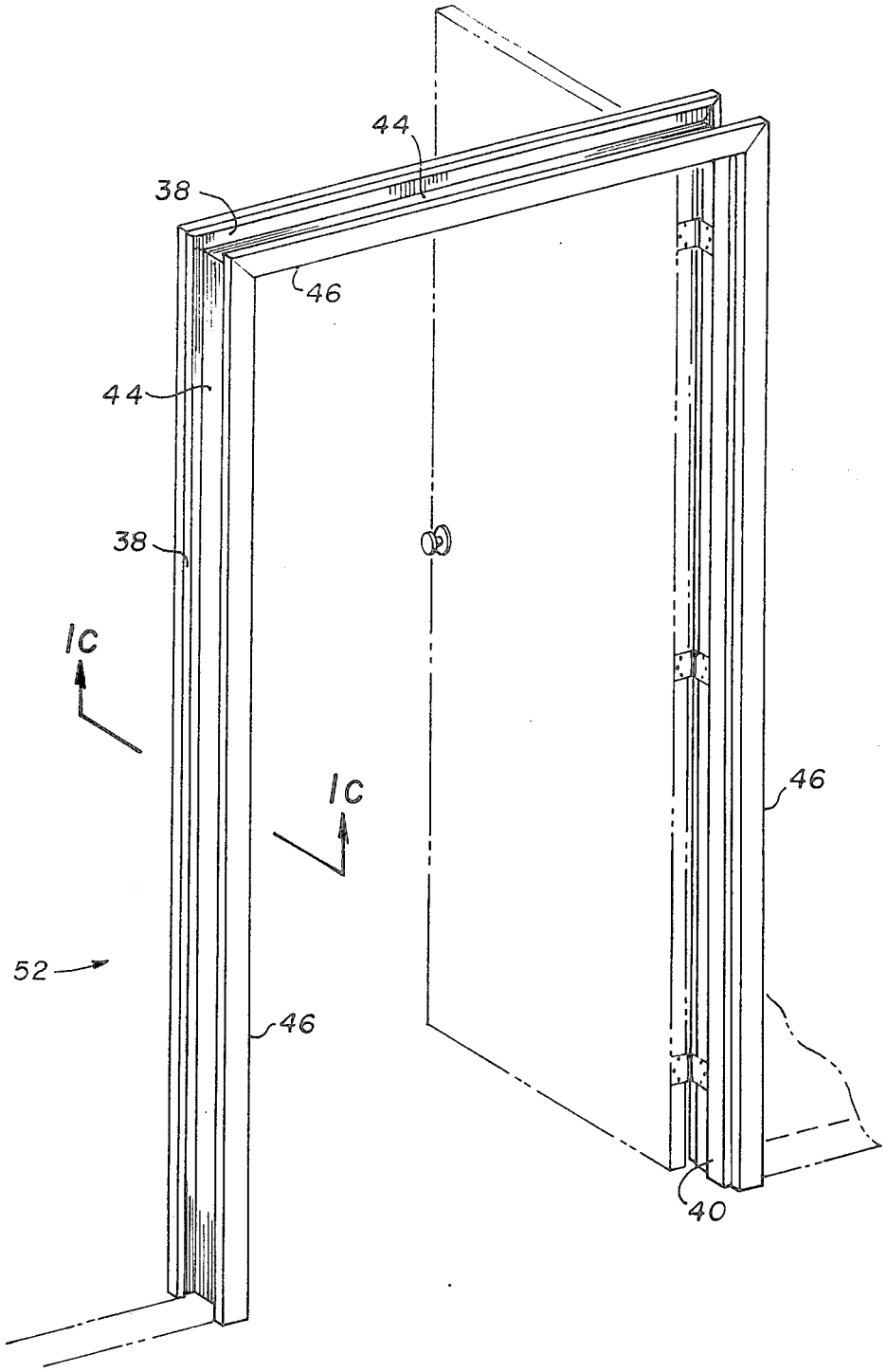
FIG. 3 is an illustration of an installed, preassembled, adjustable split door frame.

The second half of the split adjustable door frame 46 as shown in FIG. 1*c* is manufactured in a similar manner wherein a board member is clad with a piece of suitable flexible material grooved by two V-shaped grooves, folded, and glued to produce the second half of the split door frame 46. This second half of the split door frame 46 can be slidably inserted into the slot 50 of the first half of the door frame thereby making the door frame adjustable in its width. FIG. 3 illustrates an installed, preassembled adjustable split door frame 52.

What is claimed is:

1. The process of manufacturing an adjustable split door frame member, the process comprising the steps of:

a. cladding the front surface of a board with a flexible cladding material;

b. longitudinally grooving four parallel V-shaped grooves in the back of said board down to but not through said clad, each groove defining two adjacent surfaces respectively;

c. grooving down to but not through said clad a first and a second plowed groove in the back of said board parallel to and between the middle two V-shaped grooves, said first plowed groove defining first and second facing surfaces and said second plowed groove defining third and fourth facing surfaces, and said first and second plowed grooves forming a middle portion therebetween;

d. joining said board along said V-shaped grooves by folding said respective adjacent surfaces toward each other into abutting relationship and securing said board in said relationship, thereby forming first and second folded ends of said board adjacent to and outside of said first and second plowed grooves respectively;

e. joining said first and second facing surfaces together in abutting relationship along a portion thereof by moving said second surface toward said first surface, offsetting said second surface by an amount equal to the width of said first plowed groove, and securing said surfaces in said offset abutting relationship;

f. rotating said third surface away from said fourth surface by an angle of substantially 90°;

g. attaching a support member between said third and fourth surfaces, thereby securing said third and fourth surfaces in substantially perpendicular positions;

h. attaching a board member to said middle portion, said board member extending beyond said middle portion to form a slot with said second folded end.

2. The process of manufacturing a door frame member as recited in claim 1 further including the steps of:

i. cladding the front surface of a second board with a flexible cladding meterial;

j. longitudinally grooving in said second board down to but not through said clad, first and second V-shaped grooves, each groove defining two adjacent surfaces respectively; and k. joining said second board along said first and second V-shaped grooves by folding said respective adjacent surfaces toward each other into abutting relationship and securing said board in said abutting relationship, thereby forming a folded door frame member a portion of which may be slidably inserted into said slot of step (h);

3. The process of manufacturing the female portion of a door frame member from a monolithic base board, said base board being clad on one side with a flexible cladding material and having on the other side four V-shaped longitudinally extending grooves and first and second plowed longitudinally extending grooves, each of said grooves penetrating down to said clad but not through said clad, and said first and second plowed grooves defining a middle portion therebetween and being positioned between the middle two V-shaped grooves and defining first and second facing surfaces and third and fourth facing surfaces respectively, wherein the process comprising the steps of:

a. joining said board along said V-shaped grooves by folding the adjacent surfaces of said grooves toward each other into abutting relationship and securing said board in said relationship, thereby forming first and second ends of said board;

b. joining said first and second facing surfaces together in abutting relationship along a portion thereof by moving said second surface toward said first surface, offsetting said second surface by an amount equal to the width of said first plowed groove, and securing said surfaces in offset abutting relationship;

c. rotating said third surface away from said fourth surface by an angle of substantially 90°;

d. attaching a support member between said third and fourth surfaces, thereby securing said third and fourth surfaces in substantially perpendicular positions;

e. attaching a board member in said middle portion, said board member extending beyond said middle portion to form a slot with said second folded end.

* * * * *

UNITED STATES PATENT OFFICE

CERTIFICATE OF CORRECTION

PATENT NO. : 4,019,303

DATED : April 26, 1977

INVENTOR(S) : Owen Earl McAllister

It is certified that error appears in the above-identified patent and that said Letters Patent are hereby corrected as shown below:

Column 1, line 49 after "secure" insert --the surfaces--;

Column 2, lines 17, 18, and 19 omit "illustrate the successive steps for the manufacture of the second embodiment and are similar to FIGS. 1b and 1c".

Column 6, line 5 after "member" change "in" to --to--.

Signed and Sealed this

*Seventh* Day of *November 1978*

[SEAL]

*Attest:*

RUTH C. MASON
*Attesting Officer*

DONALD W. BANNER
*Commissioner of Patents and Trademarks*